US006909320B2

(12) United States Patent
Chan et al.

(10) Patent No.: US 6,909,320 B2
(45) Date of Patent: Jun. 21, 2005

(54) METHOD AND APPARATUS FOR DUAL OUTPUT VOLTAGE REGULATION

(75) Inventors: Joseph Chan, Gurnee, IL (US); Dennis Cashen, Lake Zurich, IL (US)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 10/465,753

(22) Filed: Jun. 19, 2003

(65) Prior Publication Data

US 2004/0257151 A1 Dec. 23, 2004

(51) Int. Cl.[7] ..... G05F 1/10
(52) U.S. Cl. ..... 327/541; 327/546
(58) Field of Search ..... 327/540, 541, 327/545, 546; 323/316

(56) References Cited

U.S. PATENT DOCUMENTS 4,864,216 A * 9/1989 Kalata et al. ..... 323/315
5,352,935 A * 10/1994 Yamamura et al. ..... 327/540
5,493,234 A * 2/1996 Oh ..... 326/33
5,506,541 A * 4/1996 Herndon ..... 327/541
5,903,182 A 5/1999 Jordan ..... 327/540
6,222,357 B1 * 4/2001 Sakuragi ..... 323/315
6,313,694 B1 * 11/2001 Sohn ..... 327/541
6,329,873 B2 * 12/2001 Morishita ..... 327/541
6,396,137 B1 5/2002 Klughart ..... 257/691
6,661,279 B2 * 12/2003 Yabe ..... 327/546

* cited by examiner

*Primary Examiner*—Terry D. Cunningham
(74) *Attorney, Agent, or Firm*—Fulbright & Jaworski LLP

(57) ABSTRACT

A dual output voltage regulator circuit includes a first voltage regulator section, the first voltage regulator section having a first regulated voltage output, a second voltage regulator section coupled to the first voltage regulator section, the second voltage regulator having a second regulated voltage output, and a switching circuit coupled to the first voltage regulator section and to the second voltage regulator section, the switching circuit operating the first voltage regulator section and the second voltage regulator section in a normal mode, and operating only the second voltage regulator section in a power gating mode.

7 Claims, 2 Drawing Sheets

METHOD AND APPARATUS FOR DUAL OUTPUT VOLTAGE REGULATION

BACKGROUND OF THE INVENTION

1. Field of the Invention

The invention relates generally to the field of electronics. More particularly, the invention relates to voltage regulation.

2. Discussion of the Related Art

In battery operated devices, power consumption is a crucial design consideration. Because such devices are typically kept on inactive mode (sleep or standby) for long periods of time, it is important that power consumption be minimized during inactivity. Unfortunately, even where there is little processor action, sub-micron integrated circuits (ICs) may still consume considerable amounts of electrical current due in part to transistor leakage.

As IC technology moves towards deep sub-micron dimensions, leakage power (consumed during device inactivity) can become comparable to dynamic power (consumed during device activity). For example, if a circuit contains 50 million transistors and each transistor leaks around 1 nanoampere in the "off" mode, then the total leakage current for that circuit is of approximately 50 milliampere, which is unacceptable for most battery powered wireless applications.

One solution to this problem includes removing the power supply to the circuit when in the inactive mode. However, removing the supply to an entire circuit may cause some important information to be lost. This information is typically stored in elements such as latches and/or flip-flops, and it is required for quick recovery when the device becomes active again (wake-up).

Another solution to this problem includes power gating. In power gating, certain functional blocks of the IC are turned off during inactivity (regular cells), while others are kept on (keeper cells). Because keeper cells need only to retain their states and do not draw much current from the power supply, power gating may be achieved with the use of two distinct voltage regulators. However, use of a second regulator makes this a costly solution, taking up more area and requiring at least one extra external pin.

BRIEF DESCRIPTION OF THE DRAWINGS

The drawings accompanying and forming part of this specification are included to depict certain aspects of the invention. A clearer conception of the invention, and of the components and operation of systems provided with the invention, will become more readily apparent by referring to the exemplary, and therefore nonlimiting, embodiments illustrated in the drawings, wherein like reference numerals (if they occur in more than one view) designate the same or similar elements. The invention may be better understood by reference to one or more of these drawings in combination with the description presented herein. It should be noted that the features illustrated in the drawings are not necessarily drawn to scale.

DETAILED DESCRIPTION

The invention and the various features and advantageous details thereof are explained more fully with reference to the nonlimiting embodiments that are illustrated in the accompanying drawings and detailed in the following description. It should be understood that the detailed description and the specific examples, while indicating specific embodiments of the invention, are given by way of illustration only and not by way of limitation. Various substitutions, modifications, additions and/or rearrangements within the spirit and/or scope of the underlying inventive concept will become apparent to those of ordinary skill in the art from this disclosure. The invention may include a method and/or apparatus for a dual output voltage regulator.

According to an aspect of the invention, a dual output voltage regulator circuit includes a first voltage regulator section having a first regulated voltage output, a second voltage regulator section coupled to the first voltage regulator section, the second voltage regulator having a second regulated voltage output, and a switching circuit coupled to the first voltage regulator section and to the second voltage regulator section, the switching circuit operating the first voltage regulator section and the second voltage regulator section together in a normal mode, and operating only the second voltage regulator section in a power gating mode.

According to another aspect of the invention, a method includes regulating an external power supply to produce a first and a second regulated outputs, the first and the second regulated outputs each having a voltage substantially proportional to a reference voltage, the first regulated output having a first capacity and the second regulated output having a second capacity, coupling at least one regular cell of a circuit to the first regulated output, coupling at least one keeper cell of the circuit to the second regulated output, operating the first and second regulated outputs together in a normal state, and operating only the second regulated output in a power gating state.

In one embodiment, the voltage regulator of the present invention includes a dual output voltage regulator, wherein a first power source has a high current capability and a second power source has a low current capability.

Figure 1:
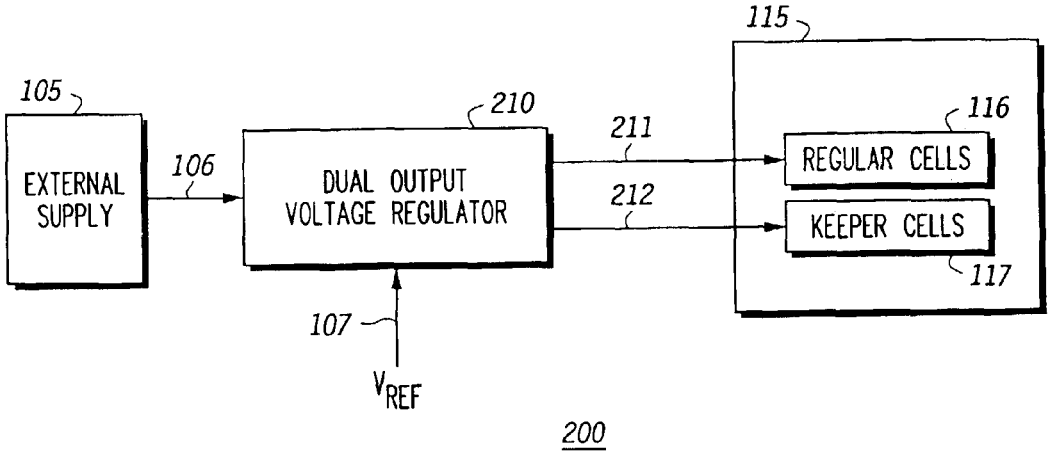
FIG. 1 is a block diagram of a dual output voltage regulator system, representing an embodiment of the invention.

Referring to FIG. 1, a block diagram of a dual output voltage regulator system 200 is depicted according to an exemplary embodiment of the invention. An external power supply 105 may provide an unregulated voltage 106 to a dual output voltage regulator 210. The dual output voltage regulator 210 may receive a reference voltage 107 and provide a first and a second regulated voltages 211, 212 to a circuit 115. The reference voltage 107 may be supplied by a reference voltage source (not shown). The circuit 115 may include at least one regular cell 116 coupled to the first regulated voltage 211 and at least one keeper cell 117 coupled to the second regulated voltage 212. The regular and keeper cells 116, 117 are connected to different power supply lines which may be physically disconnected within the circuit 115.

Circuit 115 may be any type of powered electronic circuit including, for example, a digital circuit, analog circuit, or a mixed signal circuit including both digital and analog circuitry.

In one embodiment, the first regulated voltage 211 may be a high current capacity voltage source, while the second regulated voltage 212 may be a low current capacity voltage source. In an active state, the first and second sources 211, 212 may act like a "single" high current regulated voltage source, providing power to the entire circuit 115. In an inactive state, the second source 212 may alone provide a low current regulated voltage supply to at least one keeper cell 117 of the circuit 115.

Figure 2:
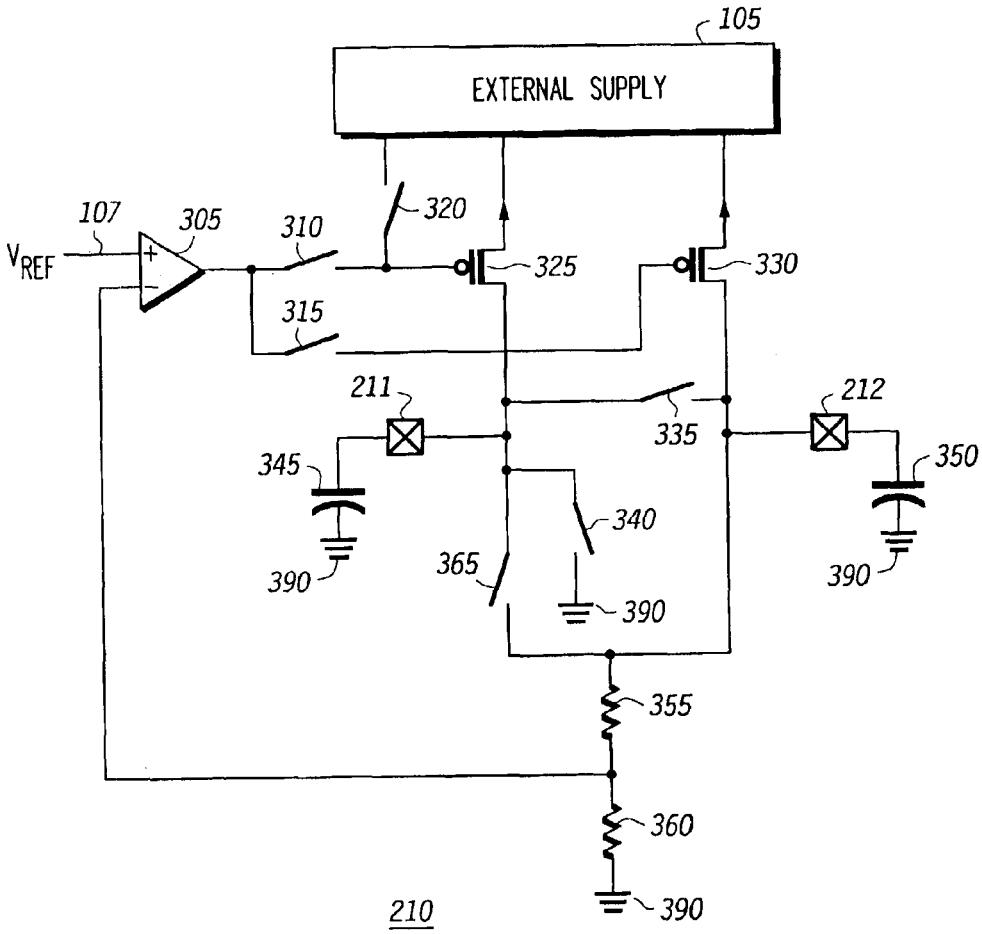
FIG. 2 is a circuit diagram of the dual output voltage regulator of FIG. 1, representing an embodiment of the invention.

Referring to FIG. 2, a circuit diagram of the dual output voltage regulator 210 of FIG. 1 is depicted according to an exemplary embodiment of the invention. The reference voltage 107 is coupled to the non-inverting input of an error amplifying circuit which may comprise an operational amplifier 305. The output of the op-amp 305 is coupled to a first switch 310 and to a first optional switch 315. The first switch 310 is coupled to a second switch 320 and to the gate of a first pass device 325. The first optional switch 315 is coupled to the gate of a second pass device 330. The second switch 320 and the sources of the first and second pass devices 325, 330 are coupled to the external power supply 105. The drain of the first pass device 325 is coupled to the drain of the second pass device 330 through a third switch 335.

The drain of the first pass device 325 is also coupled to first output terminal 211, a fourth switch 365, and a second optional switch 340. The second optional switch 340 is coupled to the ground 390. The first output terminal 211 is coupled to the ground 390 through a first capacitor 345. The drain of the second pass device 330 is coupled to a second output terminal 212, and the second output terminal 212 is coupled to the ground 390 through a second capacitor 350. The fourth switch 365 and the drain of the second pass device 330 are coupled to the first terminal of a first resistor 355. The second terminal of the first resistor 355 is coupled to the inverting input of the op-amp 305 and to the first terminal of a second resistor 360. The second terminal of the second resistor 360 is coupled to the ground 390.

In practice, the first and second pass devices 325, 330 may be, for example, positive channel metal oxide semiconductor (PMOS) transistors. Switches 310, 315, 320, 335, 340, and 365 may be, for example, complementary metal oxide semiconductor (CMOS) switches. Further, capacitors 345, 350 may be integrated capacitors, which may avoid a need for an extra external pin.

In one embodiment, the first output terminal 211 may provide power only to regular cells 116 of the circuit 115 (shown in FIG. 1). The second output terminal 212 may provide power only to keeper cells 117. When the dual output voltage regulator 210 is in an active state (normal mode), switches 310, 315, 335, and 365 are "on" and switches 320, 340 are "off". Hence, both pass devices 325, 330 are "on", and both output terminals 211, 212 may be connected together to supply power to both the regular cells 116 and sleeper cells 117 within the circuit 115. In this situation, the third switch 335 connects the both output terminals 211, 212 together. When the dual output voltage regulator 210 is in an inactive state (power gating mode), switches 315, 320, and 340 are "on" and switches 310, 335, and 365 are "off". Hence, pass device 325 are "off" and only output terminal 212 may supply power to the circuit 115.

In operation, the voltage at the gates of the pass devices 325, 330 controls the voltage at their respective drains, thereby controlling the voltage at terminals 211, 212. When the external supply 105 voltage fluctuates, the regulated output appearing at terminals 211 and/or 212 is fed back through voltage divider 355, 360 into the inverting input of the op-amp 305. The difference between the reference voltage 107 and the regulated output is applied at the gates of pass devices 325 and/or 330, effectively correcting the output such that the voltages at 211 and/or 212 are always approximately equal or proportional to the reference voltage 107.

In one embodiment, the relation between physical characteristics of the first and second pass devices 325, 330 may be expressed by: $[W/L]_2/[W/L]_1=N$; where $[W/L]_1$ is the width to length ratio of the first transistor 325, $[W/L]_2$ is the width to length ratio of the second pass device 330 and N is a real number. N may be between approximately 10 and 1000, preferably approximately between 20 and 200. In one example, N may be approximately 100. Further, the "on" resistance of the third switch 365 may be much smaller than the resistance of the first resistor 355.

The first optional switch 315 may be used in order to render the dual output voltage regulator 210 more symmetrical, presenting the gate of the second pass device 330 with approximately the same impedance that the first switch 310 presents to the gate of the first pass device 325 in active mode. Alternatively, the first optional switch 315 may be substituted by a short-circuit or a resistor. Further, the second optional switch 340 may be used to rapidly discharge a capacitor 345 to the ground 390 when in power gating mode.

Figure 3:
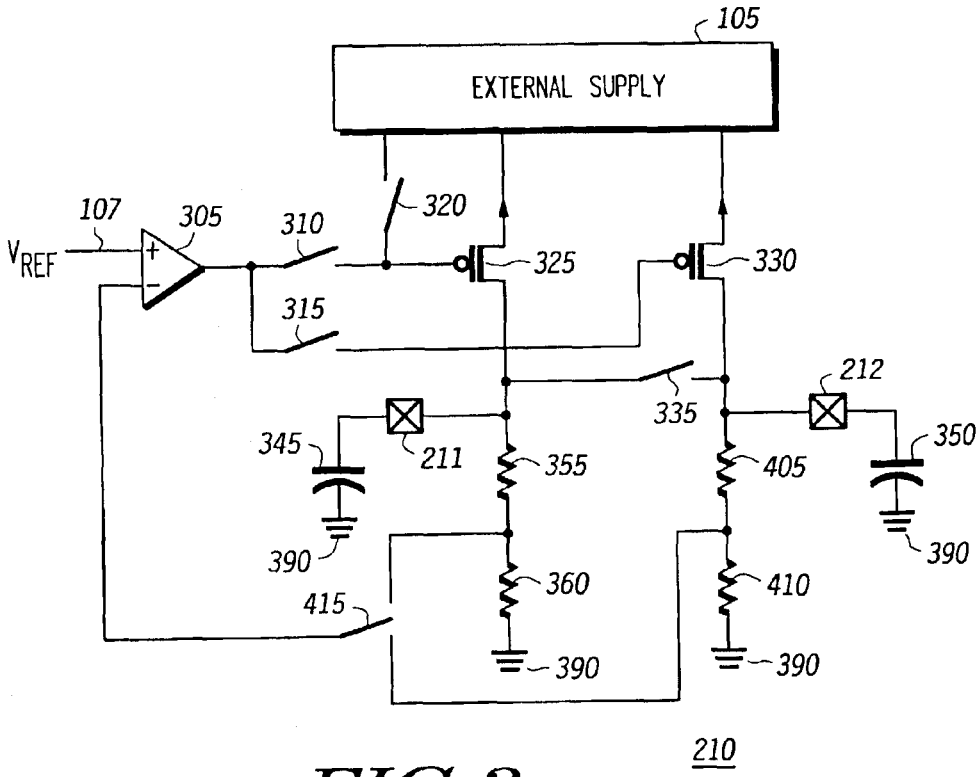
FIG. 3 is another circuit diagram of the dual output voltage regulator of FIG. 1, representing another embodiment of the invention.

Referring to FIG. 3, another block diagram of the dual output voltage regulator of FIG. 1 is depicted according to another exemplary alternative embodiment of the invention. The reference voltage 107 is coupled to the non-inverting input of the operational amplifier (op-amp) 305. The output of the op-amp 305 is coupled to the first switch 310 and to the first optional switch 315. The first switch 310 is coupled to the second switch 320 and to the gate of the first pass device 325. The first optional switch 315 is coupled to the gate of the second pass device 330. The second switch 320 and the sources of the first and second pass devices 325, 330 are coupled to the external power supply 105.

The drain of the first pass device 325 is coupled to first output terminal 211 and to the first terminal of the first resistor 355. The first output terminal 211 is coupled to the ground 390 through the first capacitor 345. The second terminal of the first resistor 355 is coupled to a fifth switch 415 and to the first terminal of the second resistor 360. The second terminal of the second resistor 360 is coupled to the ground 390. The drain of the first pass device 325 is also coupled to the drain of the second pass device 330, the first terminal of a third resistor 405, and the second output terminal 212 through the third switch 335. The second output terminal 212 is coupled to the ground 390 through the second capacitor 350. The second terminal of the third resistor 405 is coupled to the fifth switch 415 and to the first terminal of a fourth resistor 410. The second terminal of the fourth resistor 410 is coupled to the ground 390. The fifth switch 415 is coupled to the inverting input of the op-amp 305.

In a first position, the fifth switch 415 may connect the junction between resistors 355 and 360 to the inverting input of the op-amp 305. In a second position, the fifth switch 415 may connect the junction between resistors 405 and 410 to the inverting input of the op-amp 305.

When the dual output voltage regulator 210 is in an active state (normal mode), switches 310, 315 and 335 are "on", the second switch 320 is "off", and the fifth switch 415 is in the first position. Hence, both pass devices 325, 330 are "on", and both output terminals 211, 212 are connected together through switch 335 and may supply power to the circuit 115. When the dual output voltage regulator is an inactive state (power gating mode), switches 315, 320 are "on", switches 310, 335 are "off", and the fifth switch 415 is in the second position. Hence, pass device 325 is "off" and only output terminal 212 may supply power to the circuit 115.

In one embodiment, the relation between physical characteristics of the first and second pass devices 325, 330 may be expressed by: $[W/L]_2/[W/L]_1=N$; where $[W/L]_1$ is the width to length ratio of the first transistor 225, $[W/L]_2$ is the width to length ratio of the second pass device 330 and N is a real number. N may be between approximately 10 and 1000, preferably approximately between 20 and 200. In one example, N may be approximately 100.

In another embodiment, a relation between the first, second, third and fourth resistors 355, 360, 405, 410 may be given by: [R3/R4]=[R1/R2]; where R1 is the resistance of the first resistor 355, R2 is the resistance of the second resistor 360, R3 is the resistance of the third resistor 405, and R4 is the resistance of the fourth resistor 410. In yet another embodiment, another relation between the first, second, third and fourth resistors 355, 360, 405, 410 may be given by: [R1/R3]=[R2/R4]=M; where M is a real number which may be chosen as a function of the reference voltage 107 and the desired output voltage in terminals 211, 212, and the current flowing through divider 405, 410.

Figure 4:
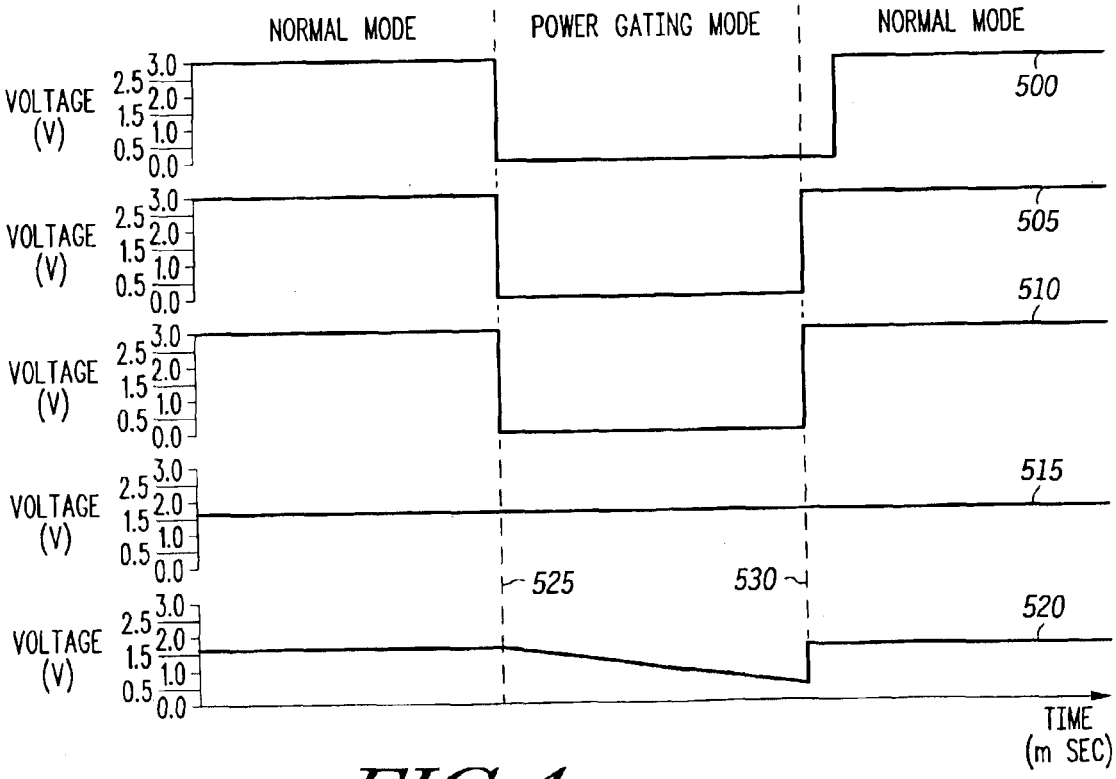
FIG. 4 is a graph of a dual output voltage regulator of FIG. 2, illustrating an embodiment of the invention.

Referring to FIG. 4, a graph of a simulation of the dual output voltage regulator of FIG. 2 is depicted illustrating an embodiment of the invention. The vertical axes are voltage in volts, and the horizontal axis is time in milliseconds. In this simulation, N was 100, the capacitance of the first capacitor 345 was 100 nF, the capacitance of the second capacitor 350 was 100 pF, the resistance of the first resistor 355 was 200KΩ, the resistance of the second resistor 360 was 100 KΩ, the unregulated external supply 105 was 3V, and the regulated supply at output terminals 211 and/or 212 was 1.6V. The second optional switch 340 was absent, and a leakage current of 100 $\mu$A was added to the regular cells 116 of the circuit 115.

A first graph 500 shows the voltage across the terminals of the fourth switch 365. A second graph 505 shows the voltage across the terminals of the first switch 310. A third graph 510 shows the voltage across the terminals of the third switch 335. A fourth graph 515 shows the voltage at the second output terminal 212. A fifth graph 520 shows the voltage at the first output terminal 211.

As seen in graphs 500–520, the dual output voltage regulator 210 is initially in normal mode. It enters a power gating mode at time 525, and returns to normal mode at time 530. During power gating (i.e.: the first pass device 325 is "off"), the voltage at the second output terminal 212 remains unchanged (1.6V) while the voltage at the first output terminal 211 decreases as the first capacitor 345 discharges due to the leakage current. The voltage across the fourth switch 365 changes back to 3.0V sometime after the regulator 210 returns to normal mode, in order to avoid bleeding the voltage at the first terminal 211 too early.

The terms a or an, as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically. The term approximately, as used herein, is defined as at least close to a given value (e.g., preferably within 10% of, more preferably within 1% of, and most preferably within 0.1% of). The term substantially, as used herein, is defined as at least approaching a given state (e.g., preferably within 10% of, more preferably within 1% of, and most preferably within 0.1% of).

The appended claims are not to be interpreted as including means-plus-function limitations, unless such a limitation is explicitly recited in a given claim using the phrase(s) "means for" and/or "step for." Subgeneric embodiments of the invention are delineated by the appended independent claims and their equivalents. Specific embodiments of the invention are differentiated by the appended dependent claims and their equivalents.

What is claimed is:

1. A dual output voltage regulator circuit, comprising:

a first voltage regulator section including a first pass device, and having a first regulated voltage output with a first current capacity;

a second voltage regulator section coupled to the first voltage regulator section, the second voltage regulator section including a second pass device, having a second regulated voltage output with a second current capacity less than the first current capacity, a width to a length ratio of the first pass device relative to a width to a length ratio of the second pass device being in the range of approximately 10 to 1000; and a switching circuit coupled to the first voltage regulator section and to the second voltage regulator section, the switching circuit operating the first voltage regulator section together with the second voltage regulator section in a normal mode, and operating only the second voltage regulator section in a power gating mode.

2. The dual output voltage regulator circuit of claim 1, the first regulated voltage output having a voltage approximately equal to a voltage of the second regulated voltage output.

3. The dual output voltage regulator circuit of claim 2, the voltage of the first regulated voltage output being proportional to a reference voltage.

4. The dual output voltage regulator circuit of claim 2, the voltage of the second regulated voltage output being proportional to the reference voltage.

5. The dual output voltage regulator circuit of claim 1, further comprising an error amplifying circuit coupled to control the first voltage regulator section and to control the second voltage regulator section.

6. The dual output voltage regulator circuit of claim 1, the ratio being in the range of approximately 20 to 200.

7. The dual output voltage regulator circuit of claim 6, the ratio being approximately 100.

* * * * *

UNITED STATES PATENT AND TRADEMARK OFFICE

CERTIFICATE OF CORRECTION

PATENT NO. : 6,909,320 B2
DATED : June 21, 2005
INVENTOR(S) : Chan et al.

It is certified that error appears in the above-identified patent and that said Letters Patent is hereby corrected as shown below:

Column 6,
Line 28, before "having a second", please insert -- and --.

Signed and Sealed this

Twenty-seventh Day of September, 2005

JON W. DUDAS
*Director of the United States Patent and Trademark Office*